US005531624A

United States Patent [19]

Dunipace

[11] Patent Number: 5,531,624

[45] Date of Patent: Jul. 2, 1996

[54] FLYING DISC

[75] Inventor: David B. Dunipace, Fontana, Calif.

[73] Assignee: Innova Champion Discs, Inc., Ontario, Calif.

[21] Appl. No.: 205,516

[22] Filed: Mar. 2, 1994

Related U.S. Application Data

[63] Continuation-in-part of Ser. No. 18,864, Feb. 14, 1994.

[51] Int. Cl.[6] ..... A63B 65/10

[52] U.S. Cl. ..... 446/46; 273/424

[58] Field of Search ..... 446/34, 46–48; 273/424, 425; D21/82, 85, 86

[56] References Cited

U.S. PATENT DOCUMENTS

| | | | |
|---|---|---|---|
| D. 212,194 | 9/1968 | Asner | D21/86 |
| D. 295,429 | 4/1988 | Sandeen | D21/86 |
| D. 327,921 | 7/1992 | Sobel | D21/86 |
| D. 346,413 | 4/1994 | Hellerman | D21/86 |
| D. 346,626 | 5/1994 | St. Lawrence | D21/86 |
| 1,986,937 | 1/1935 | MacGregor | 273/425 |
| 3,177,654 | 4/1965 | Gradecak | 60/35.5 |
| 3,312,472 | 4/1967 | Kerr | 273/106 |
| 3,359,678 | 12/1967 | Headrick | 46/74 |
| 3,673,731 | 7/1972 | Farhi et al. | 46/47 |
| 3,710,505 | 1/1973 | Linenfelser | 46/74 D |
| 3,724,122 | 4/1973 | Gillespie | 446/46 |
| 3,758,985 | 9/1973 | Heisler | 46/74 D |
| 3,852,910 | 12/1974 | Everett | 46/74 D |
| 4,080,753 | 3/1978 | Hiner et al. . | |
| 4,114,885 | 9/1978 | Morrow | 273/106 B |
| 4,157,632 | 6/1979 | Everett | 273/424 |
| 4,171,704 | 10/1979 | Sarkis | 131/178 |
| 4,176,843 | 12/1979 | DeWitt, Jr. | 273/106 B |
| 4,204,357 | 5/1980 | Harrington | 46/74 D |
| 4,205,484 | 6/1980 | Kovac et al. | 46/74 D |
| 4,212,131 | 7/1980 | Ross | 273/424 |
| 4,222,573 | 9/1980 | Adler | 273/426 |
| 4,223,473 | 9/1980 | Brown | 46/74 D |
| 4,253,269 | 3/1981 | Sullivan | 46/74 D |
| 4,255,893 | 3/1981 | Anderson | 273/424 |
| 4,279,097 | 7/1981 | Walker | 46/74 D |
| 4,290,226 | 9/1981 | Stauffer | 46/74 D |
| 4,302,901 | 12/1981 | Psyras | 46/74 D |
| 4,302,902 | 12/1981 | Adler | 46/132 |
| 4,320,593 | 3/1982 | Sarkis | 46/74 D |
| 4,334,385 | 6/1982 | Melin et al. | 46/74 D |
| 4,351,129 | 9/1982 | Kerkenbush et al. | 46/74 D |
| 4,354,326 | 10/1982 | Mathews | 273/424 |
| 4,456,265 | 6/1984 | Adler | 273/425 |
| 4,479,655 | 10/1984 | Adler | 273/425 |
| 4,560,358 | 12/1985 | Adler | 446/46 |
| 4,568,297 | 2/1986 | Dunipace | 446/46 |
| 4,919,083 | 4/1990 | Axelrod | 273/424 |
| 5,045,011 | 9/1991 | Lovik | 446/46 |
| 5,078,637 | 1/1992 | McFarland | 446/46 |

FOREIGN PATENT DOCUMENTS 2306132 8/1974 Germany .

OTHER PUBLICATIONS

Sample of "blue disc" acquired Feb. 1991—located in file.

Excerpts from "Adler Notebooks," book V pp. 3, 4, 25, 26, 46 and 47, book VI p. 24, Sep. 1979, Oct. 1979 and Jun. 1984.

*Discovering the World catalogue,* pp. 1, 19–21.

Flying Saucer Disc (four photographs showing a white disc with raised letters on top "FLYING SAUCER").

(List continued on next page.)

*Primary Examiner*—Mickey Yu
*Assistant Examiner*—Jeffrey D. Carlson
*Attorney, Agent, or Firm*—Lyon & Lyon

[57] ABSTRACT

A flying disc, such as used for catching and/or throwing, constructed in a single piece structure integrally molded from flexible plastic material having a central flight plate section, an outer rim, and a shoulder section connecting the central flight plate section to the outer rim, the top surface of the outer rim having a raised ridge which provides a gripping surface and which gives the appearance of a rear spoiler which is believed to act as a rear control or deflection surface on the trailing edge of the disc.

36 Claims, 11 Drawing Sheets

OTHER PUBLICATIONS

Wham–O® Frisbee model Fastback flying disc (four photographs).
Humphrey Flyer/Flying disc bearing the markings "Philadelphia Wings National Lacrosse League" (four photographs).
Innova Zephr (original version) disc (1993).
Innova Super Nova (original version) disc (1993).
Innova Birdie disc (1993).
Innova Viper disc (1993).
Dr. Stancil E. D. Johnson, *Frisbee: A practitioner's manual and definitive treatise,* 1975, pp. 28–32, 36, 37, 39–41, 170–173.
G. D. Stilley et al., AIAA Paper No. 72–982, Adaptation of the Frisbee Flight Principle to Delivery of Special Ordnance, 1972, pp. 1–16.
Paul Katz, The Free Flight of the Rotating Disc, *Israel Journal of Technology,* 1967, pp. 150–155.
Dr. Frank Ryan, Discus, *the Viking Library of Sports Skills,* 1973, FIGS. 4a–4d, 10a–10f.
Jess Jarver, The Throws, 1980, pp. 93–101.
Robert L. Forward Yearbook of Science and the Future, *Encyclopedia Britannica, Inc.,* 1987, 1 pg.
David C. Allon, *High Technology,* 1986, 1 pg.
Michael Segell, *Sports Illustrated,* 1985, 1 pg.
Edward Edelson, "Lord of the Rings", *Popular Science,* Sep. 1986, pp. 94–95.
*Science News,* vol. 127, No. 10, Mar. 9. 1985, "Technology: Ringing in a world record", 1 pg.
*Scientific American,* "Winging It", May 1985, 1 pg.
*Scientific American,* "'Flying ring' inventor revamps the boomerang", Jun. 1990, 1 pg.
Jonathan Eisenberg, *The Stanford Daily,* Apr. 3, 1990, 1 pg.
C. J. Fenrick, "Lord of the Flying Ring Returns", *Astrogram, NASA,* Mar. 2, 1990, vol. XXXII, No. 12, 1 pg.
Andrew Pollack, "In High–Tech Silicon Valley, Entrepreneurs Turn to Toys", *The New York Times,* Dec. 25, 1984, 1 pg.
David F. Falisbury, "Inventor finds an aerodynamic flying rings that flings the farthest", *The Christian Science Monitor,* Feb. 8, 1985, 1 pg.

FLYING DISC

RELATED APPLICATIONS

This application is a continuation-in-part of U.S. application Ser. No. 29/018,864 filed Feb. 14, 1994.

BACKGROUND OF THE INVENTION

The field of the present invention relates to flying discs of circular shape which are injection molded in a single molding operation and more particularly to sport discs such as the omni-present Frisbee® brand flying disc sold by Wham-O® of San Gabriel, Calif.

Flying discs are used in many recreational activities, the most common being the game of throw and catch. Another disc sport experiencing growth in popularity is disc golf where a player throws a disc toward a basket device which serves as the "hole". Most holes are about 100 yards (60 meters) long and a player gets three "shots" or throws in order to make "par" for the hole. There are now disc golf courses throughout the United States and in many other countries. Many other sports and games are also played with flying discs, notably the game of Ultimate which is a team throw and catch game similar to soccer or football in which a team advances the disc by throwing only. The flight path precision despite adverse wind conditions and ease of throwing are key factors.

For any design of flying disc, the criteria by which the present inventor evaluates a flying disc includes (1) throwability—how easily is the disc gripped and released, (2) flight characteristics—how does the disc fly, including flight path, flight path precision, flight stability, drag, lift, ballistics, and susceptibility to flight path deflection by wind and (3) durability—how a disc stands up to wear and tear including scuffing and collisions (such as trees) and what impact such wear has on the disc's flight characteristics.

Flight stability of the disc will be described as the flight characteristic of how well the disc "holds its intended line" during its flight, particularly when thrown at higher speeds. A disc's flight path is not necessarily a perfectly straight line but actually an "S" curve. If the degree of the "S" curve is too extreme, the disc is not readily controllable and is considered "unstable". A disc that is "unstable" will undesirably turn over and fall i.e "crash") when thrown at a given speed. A thrower desires a disc to fly in a predictable pattern despite varying or high wind conditions, or when the disc is thrown at high speed (such as for longer distance throws or throws into the wind), medium speed (such as for medium distance throws or when playing catch), or low speed (such as for short throws or when putting in disc golf). A disc may still be considered "stable" despite a tendency of the disc to bank slightly to the side (right or left). In the sport of disc golf, some discs are used for that very purpose. In disc golf parlance, a disc is "overstable" if it has a tendency to bank slightly opposite to the direction of spin (i.e. slightly to the left for a right handed backhand throw) at a given speed. Similarly, a disc is "understable" if it banks slightly in the direction of spin (i.e. to the right for a right handed backhand throw) at higher speeds.

The most widely recognized flying disc is the conventional Frisbee® such as the Pro™ model having a flat central section and a downwardly extending rim with a blunt edge, the disc having a continuously curved transition from the central section to the rim. This design for years was considered, and for many uses is still considered, a preferred disc design. However, the conventional Frisbee® Pro™ model design has limitations in grip characteristics, durability, and in distance throwing or windy conditions.

The present inventor's U.S. Pat. No. 4,568,297 describes a flying disc having good throwability, superior distance and superior flight path predictability as compared to the conventional Frisbee® design. Flying discs made under that patent are manufactured and sold by Innova Champion Discs, Inc. of Ontario, Calif. These discs have a low profile, a triangular rim (the so-called "beveled edge") providing increased mass at the rim, and a flexible central section. The Innova discs have set world records for distance, have revolutionized the sport of disc golf and are the discs of choice for professional disc golfers worldwide.

The present inventor has recognized there is still room for additional improvement in the design of flying discs.

SUMMARY OF THE INVENTION

The present invention is directed to a flying disc constructed in a single piece structure integrally molded from flexible plastic material having a central flight plate section, an outer rim, and a shoulder section connecting the central flight plate section to the outer rim, the top surface of the outer rim having a raised ridge, the raised ridge having an inner upwardly sloping surface to a transition point or apex, and then outwardly transitioning to a downwardly sloping upper rim surface to the disc outer edge, the upwardly sloping surface being generally straight or concave rather than convex (i.e. non-convex), and the downwardly sloping upper rim surface being generally straight or convex rather than concave (i.e. non-concave).

DETAILED DESCRIPTION OF PREFERRED EMBODIMENTS

Figure 1:
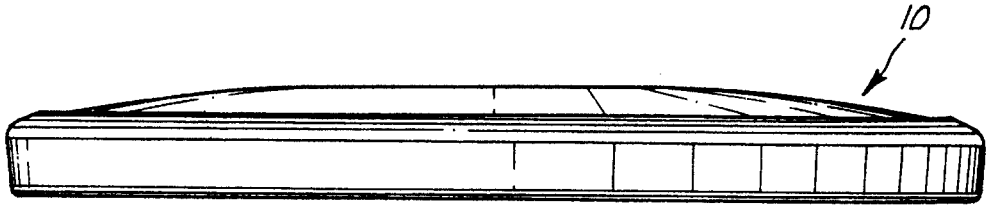
FIG. 1 is a side elevation view of a preferred embodiment of a flying disc according to the present invention.
Figure 2:
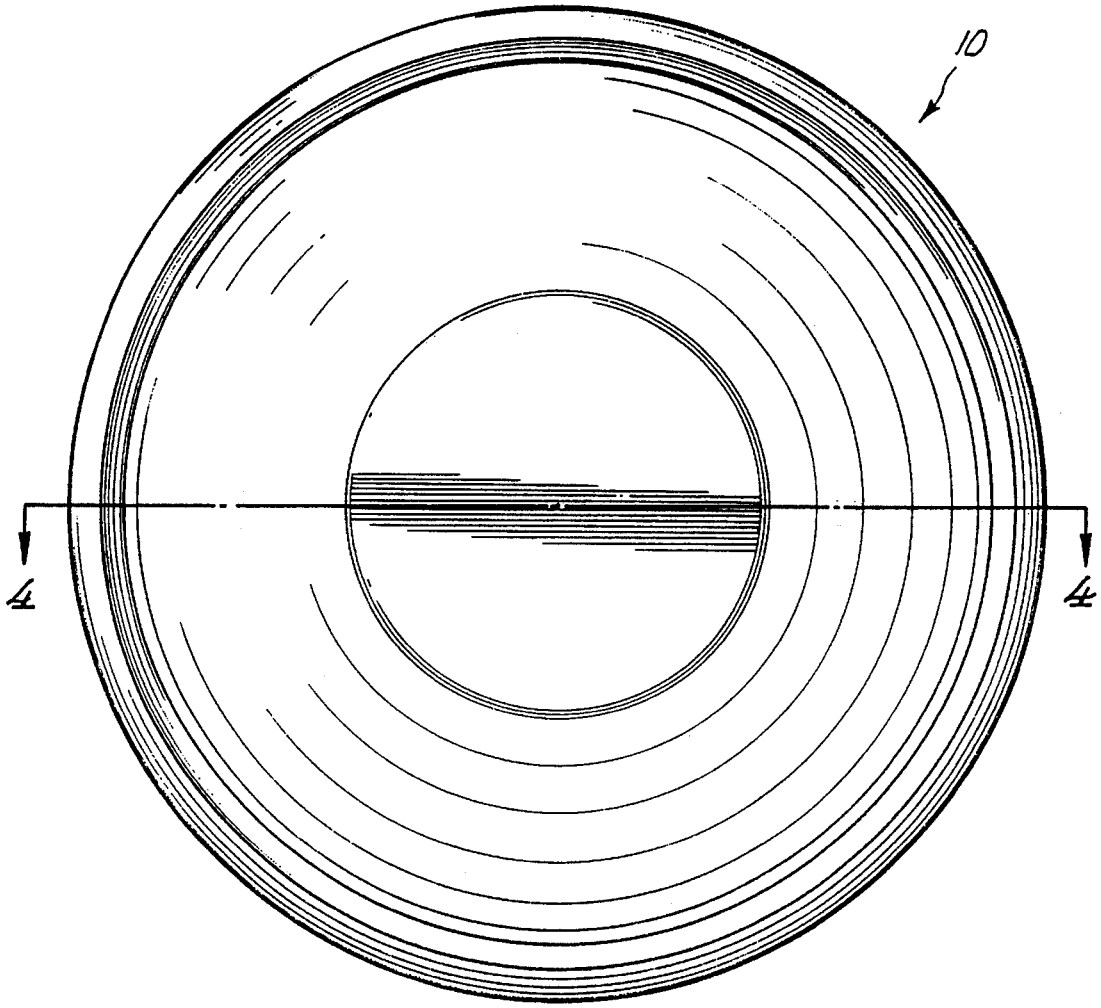
FIG. 2 is a top plan view of the flying disc of FIG. 1.
Figure 3:
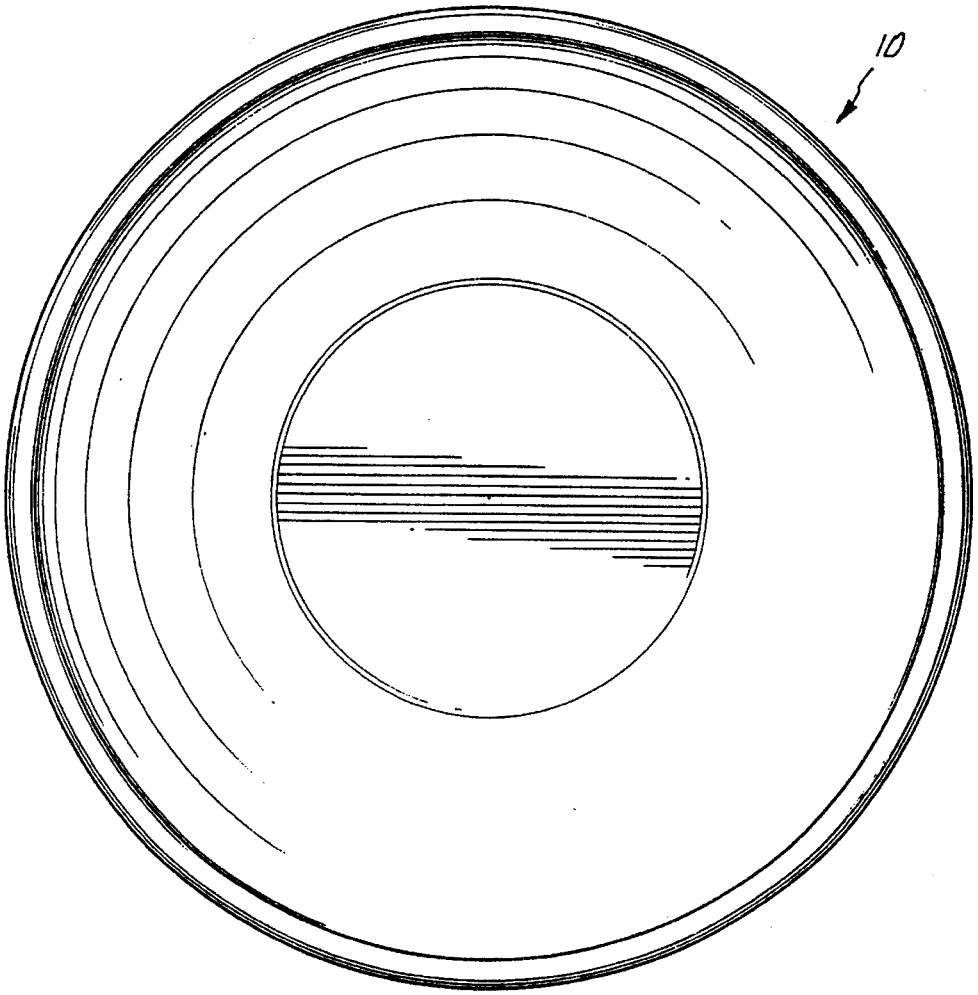
FIG. 3 is a bottom plan view of the flying disc of FIG. 1.

It may be noted that in the descriptions herein, a disc may be described and/or claimed by terms such as "upward", "downward", "inner", "outer", "beneath" or the like for the purposes of facilitating description of the disc structure. These terms are intended as relative terms to describe relative directions about the disc structure as though the disc being described were observed in a horizontal, upright orientation such as illustrated in the cross sectional views herein. In other words, the disc may be described relative to a conventional coordinate system (polar or ordinate) which is centered on the disc and which would move with the disc as the disc travels in flight, or as it is moved, gripped, or thrown. As a further clarification, the term "inward" or "inner" means radially toward the center of the disc and "outward" means radially away from the center of the disc.

FIGS. 1–4, 4A illustrate a first preferred design of a flying disc 10. The disc 10 is a single piece structure which is integrally molded from flexible plastic material. The disc 10 has a circular shape (as shown in top and bottom views FIGS. 2–3) which is symmetrical about a central axis 22. In order to further describe this disc embodiment by way of example, FIGS. 1–4, 4A are generally drawn to scale with the disc 10 having an outer diameter of about 24 cm. The rim 40 contains about 60% of the mass of the disc. For a recreational catch-style disc, this disc may have mass of about 120 gm–130 gm. A higher density golf style disc may have higher mass up to about 200 gm. These weights and weight distributions for this disc (and the other weights given for the discs below) are preferred example values and may be modified by the disc designer. It should be noted that the upper weight range is arbitrarily dictated by the Professional Disc Golf Association which limits the weight of approved golf discs to a maximum weight to diameter ratio.

The disc 10 includes a central flight plate section 20, an outer rim 40, and a shoulder section 29 connecting the central flight plate section 20 to the outer rim 40. The flight plate section 20 is comprised of a center portion 24 and a convex transition section 26. Though the center portion 24 will usually be generally flat to facilitate application of a hot stamp, it may be somewhat cambered (upwardly domed or rounded). The central flight plate section 20 is shown with approximately uniform thickness (it may alternately be of varying and/or decreasing thickness from the shoulder 29 to the center axis 22) and it is preferred that it be sufficiently thin and flexible that the disc will bend on impact and allow the user's thumb to be pressed into the plate 20 when gripping.

Figure 8A:
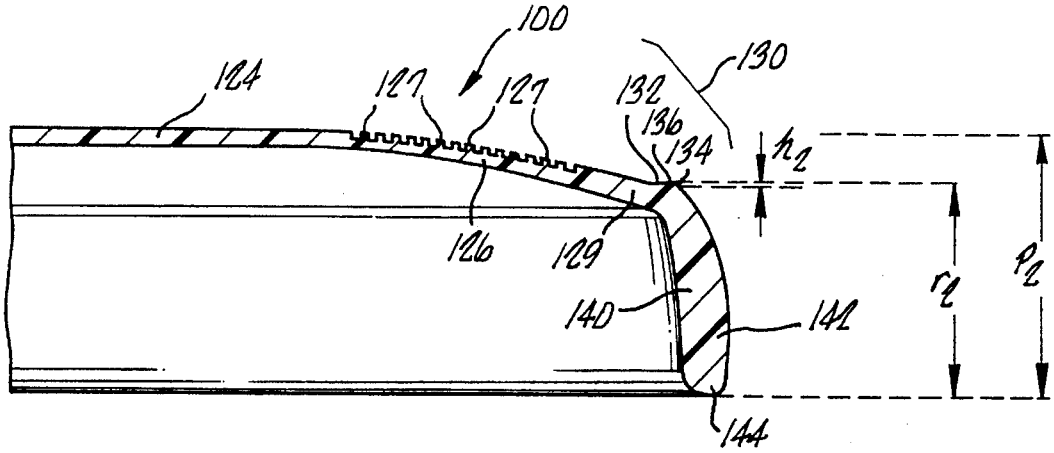
FIG. 8A is an enlarged view of the rim section of the flying disc of FIG. 8.
Figure 5:
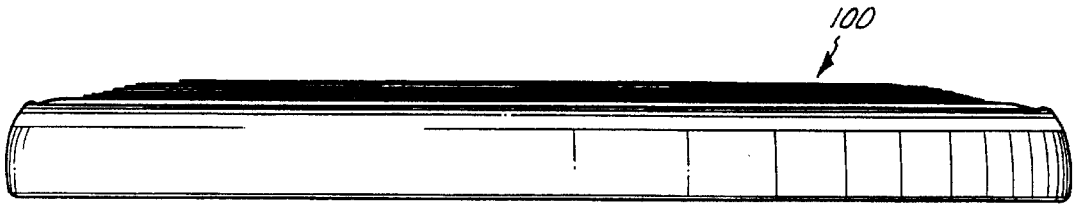
FIG. 5 is a side elevation view of an alternate flying disc.
Figure 7:
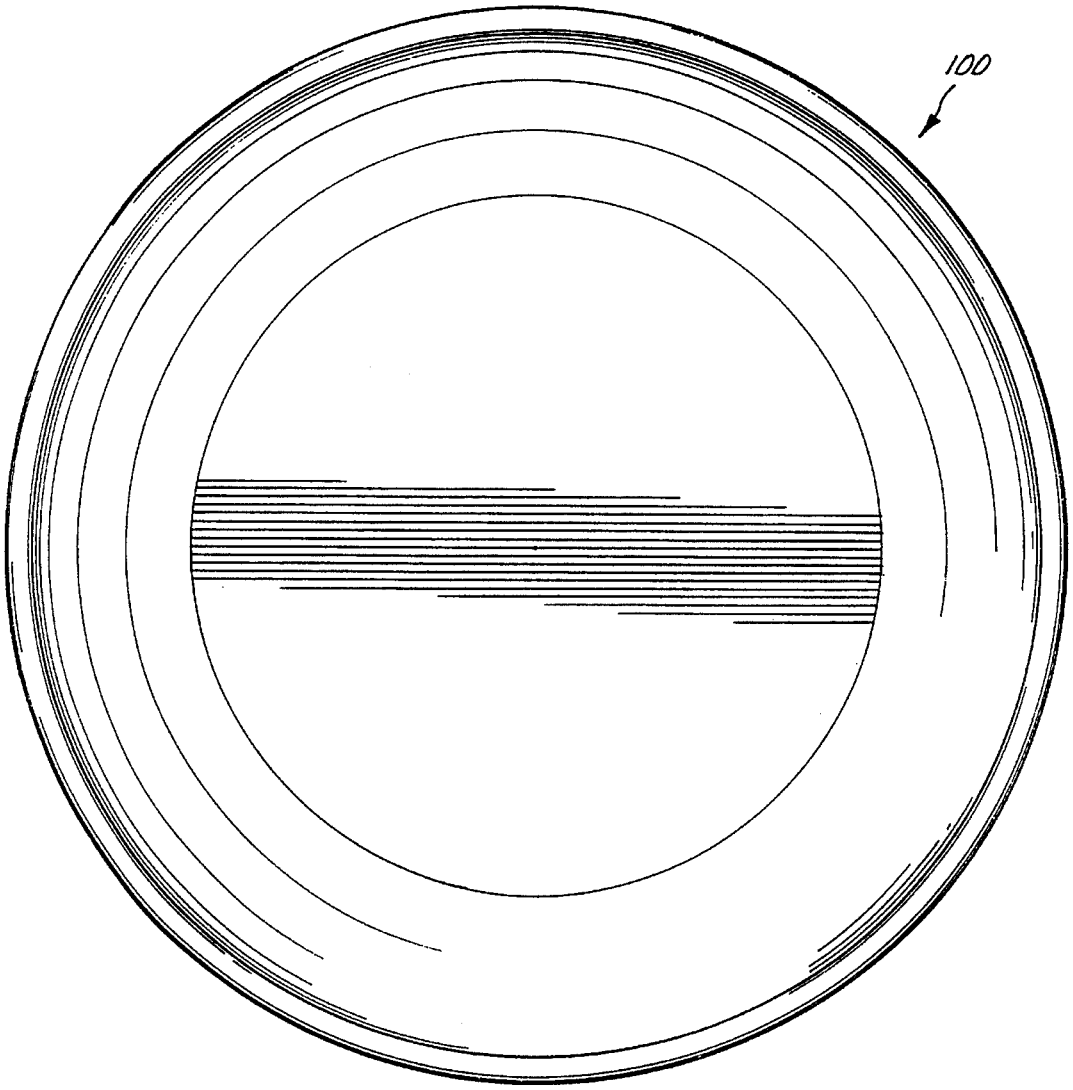
FIG. 7 is a bottom plan view of the flying disc of FIG. 5.
Figure 8:
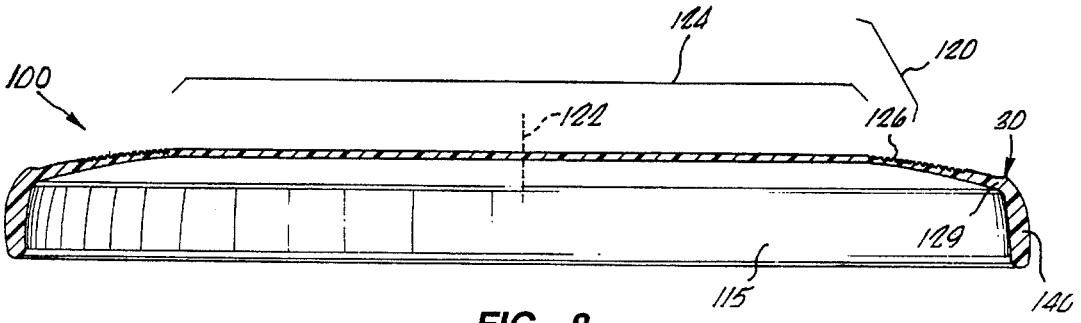
FIG. 8 is a sectional view of the flying disc of FIG. 7 taken along line 8—8.
Figure 6:
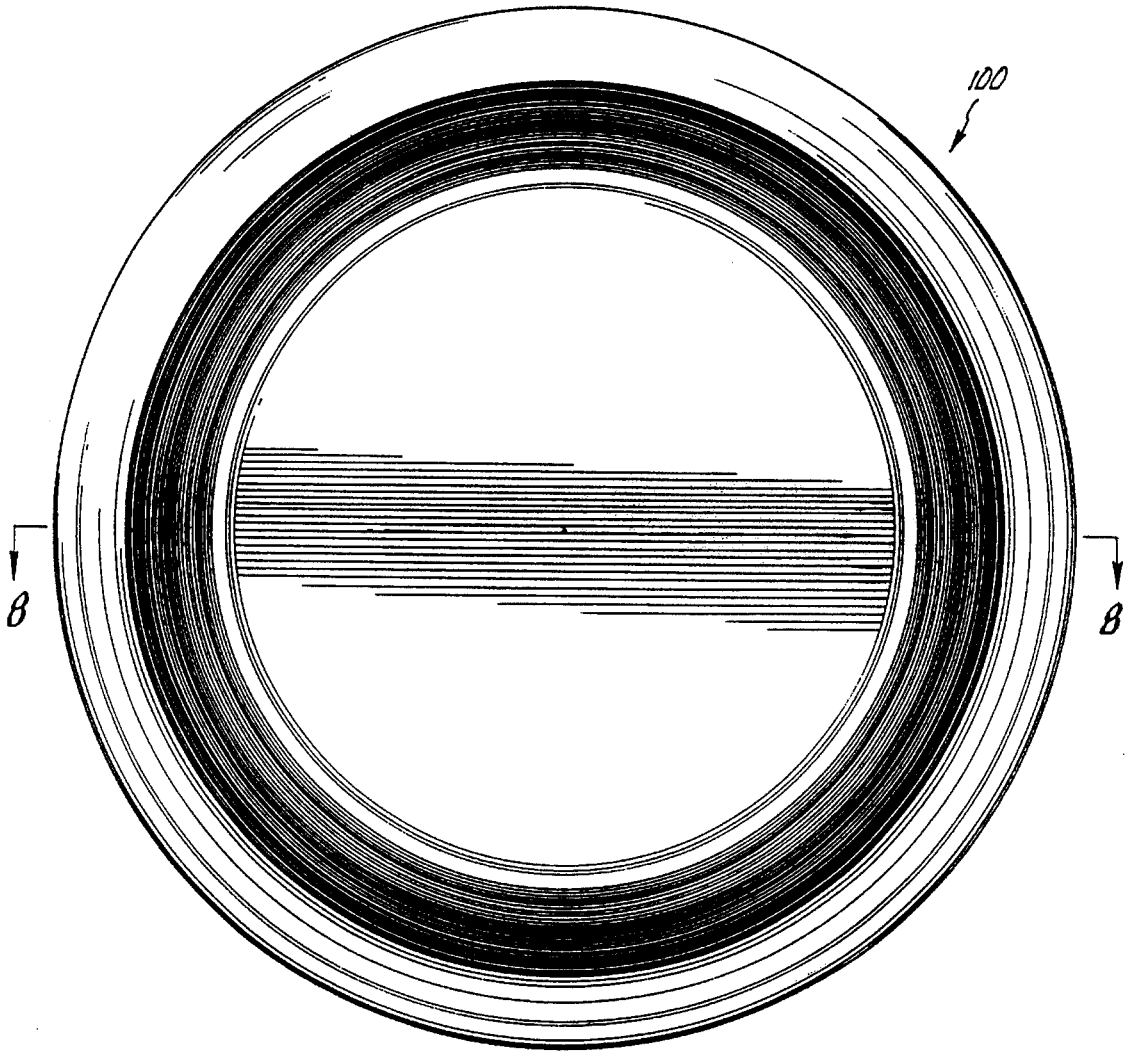
FIG. 6 is a top plan view of the flying disc of FIG. 5.
Figure 9:
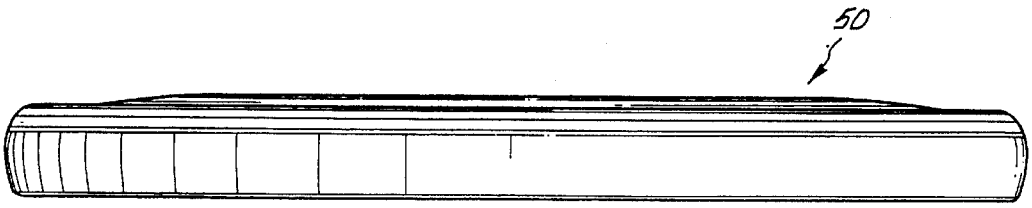
FIG. 9 is a side elevation view of another alternate flying disc.
Figure 10:
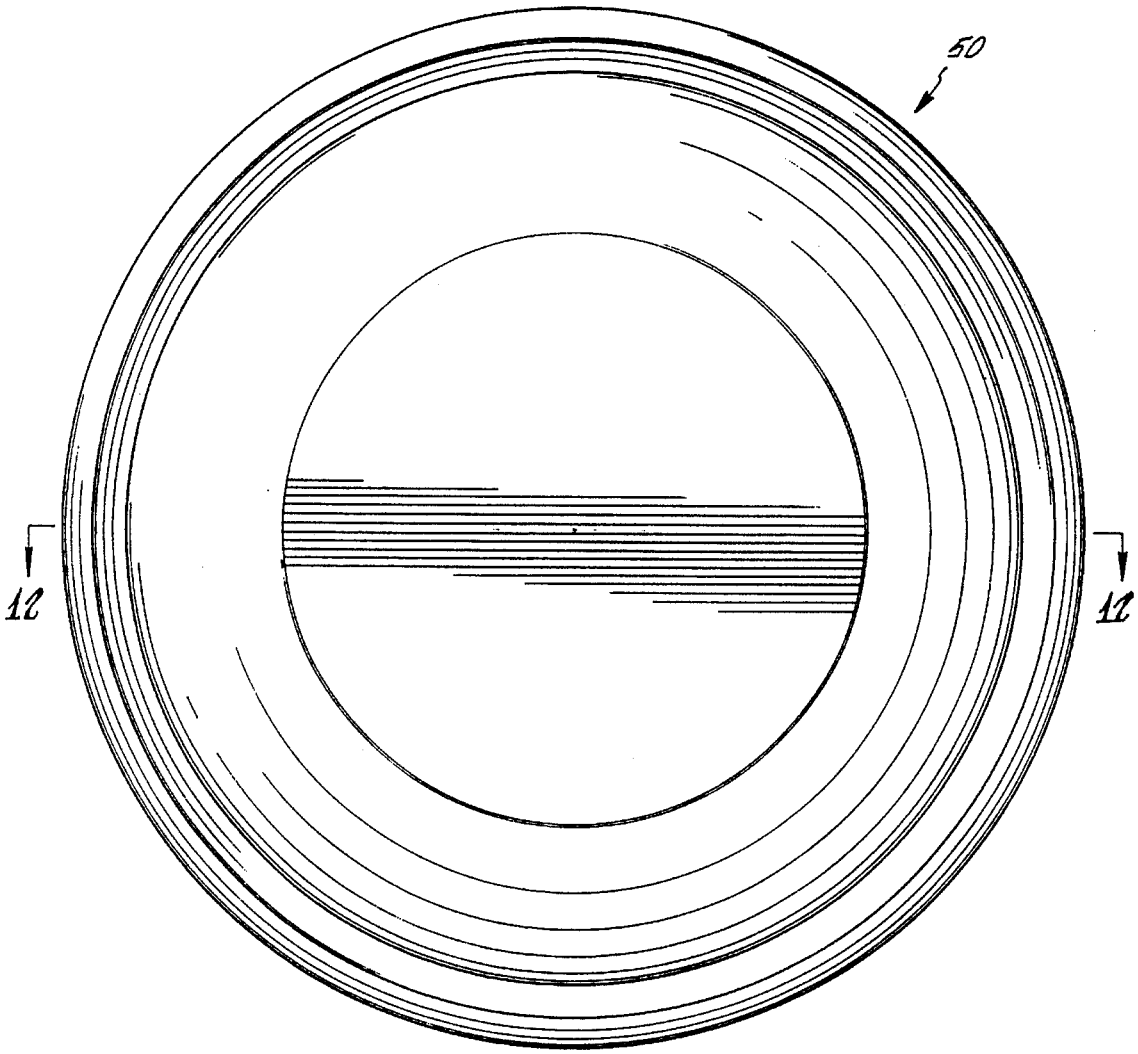
FIG. 10 is a top plan view of the flying disc of FIG. 9.

The outer rim 40 has an outer rounded edge 42, a lower rounded corner 44 and an inner rim surface 45. The outer rim 40 extends downwardly from the shoulder section 29 enclosing or bounding a central cavity 15 below the central flight plate section 20 and radially inward from the inner rim surface 45. In other words, in a radial sense, the rim 40 defines or sets an outer boundary of a central cavity below the central flight plate section 20. The central flight plate section 20 is a relatively thin plate, having a thickness on the order of 0.2 cm. The flight plate section 20 includes a top surface and a bottom surface. The top surface may have ridges or indentations (see example the gripping rings 127 in FIG. 8A), but the bottom surface is usually generally smooth.

It is the top surface of the disc over which the air must pass as the disc travels through the air. Since the disc is symmetrical about its centerline, the top surface of the disc may be described from its centerline progressively radially outward to its outer edge (i.e. the leading and/or trailing edge). This convention will be used herein to describe the top surface of the disc 10.

The top surface of the disc 10 has a generally flat center portion 24 which transitions to a downwardly sloping convex transition section 26. The top surface of the disc 10 includes a raised lip or ridge 30 in the vicinity the rim 40 or the shoulder 29. The raised ridge 30 includes an upwardly sloping surface 32, a transition point or apex 36, and a downwardly sloping upper rim surface 34 which transitions to the outer rounded edge 42 of the rim 40. The upwardly sloping surface 32 is generally straight or concave rather than convex, and the downwardly sloping upper rim surface 34 is generally straight or convex rather than concave.

The transition point or apex 36 is the zenith or the uppermost extension of the raised ridge 30. The transition point 36 preferably constitutes a sharp or abrupt transition between the upwardly sloping surface 32 and the downwardly sloping upper rim surface 34 as opposed to a gradually curved or more rounded transition. It is understood that the transition point 36 need not be as sharp as a knife or needle point, but defines a relatively abrupt or rapid transition between the upwardly sloping surface 32 which is generally straight or concave rather than convex and the downwardly sloping upper rim surface 34 which is generally straight or convex rather than concave. The actual transition 36 may be described as a corner having a relatively small radius (such as on the order of 0.2 cm or preferably less than 0.1 cm). By radius it is meant, as one skilled in the art would understand, similar to the radius term set forth in specifications made in drawings for manufacturing of metal parts in which corners are broken to a specified radius.

Unlike a conventional wing which has a leading edge which is separate from the trailing edge, in a flying disc (since it rotates) its outer edge functions as both the leading edge and the trailing edge. With the raised ridge 30 on the trailing side of the disc 10, the air stream that has passed over the top of the disc hits the transition point 36 (which on the trailing side is relatively sharp or abrupt) and then passes over the more gradual downwardly sloping surface 34 before falling off the rounded outer edge 42. On the trailing edge, the raised ridge may look like a spoiler and it is believed that raised ridge 30 with its transition point 36 may function as a rear control or deflection surface. On the leading edge side, it is thought that the downwardly sloping surface 34 of the raised ridge 30 provides gradual leading edge transition for the air to pass over the top of the disc. Whatever the aerodynamic effect, the present inventor has recognized positive impact of the raised ridge 30 on the disc's flight dynamics. Even if it may appear that the size of the raised ridge 30 is somewhat small, it may be recognized that small changes in shapes of an airfoil may have significant aerodynamic effects.

The size of the raised ridge 30 depends upon the size and configuration of the disc 10. Throwing tests have shown that for the example configuration of disc 10, at higher air speeds, the disc with the ridge 30 resists turning over. At lower speeds, the ridge 30 appears to have little (actually no noticeable effect) on disc flight. It appears that the ridge 30 augments disc stability at higher air speed where it is needed but does not impact flight at lower speeds where the disc already had desirable flight characteristics.

No matter what the aerodynamics of the disc are theoretically, the real test for a disc is how it performs when thrown. Tests have shown that the addition of the raised ridge 30 to the top surface of the rim 40 provides a stabilizing effect on disc flight. As such, with the addition of the raised ridge, the disc 10 may have one or more (but not necessarily all) of the following advantages as compared to a disc of similar shape but without the raised ridge:

(1) the disc 10 may be thrown at a greater range of speeds without turning over, (2) the disc 10 may be thrown at a higher speed without turning over, (3) the disc 10 may tend to fly along a more predictable path during adverse wind conditions, (4) the raised ridge 30 provides a thumb grip to aid throwing (which might be preferred by certain throwers), (5) the disc 10 appears to better maintain its flight characteristics when the disc becomes worn or "scuffed up."

As previously stated, to aid description, the disc 10 has been generally drawn to scale and an example preferred diameter for the disc is about 24 cm with the total disc height or profile $p_1$ being about 2.75 cm. It is noted that the overall height of a disc made from the same mold may vary depending upon several factors including material formulation and injection molding parameters.

Figure 4:
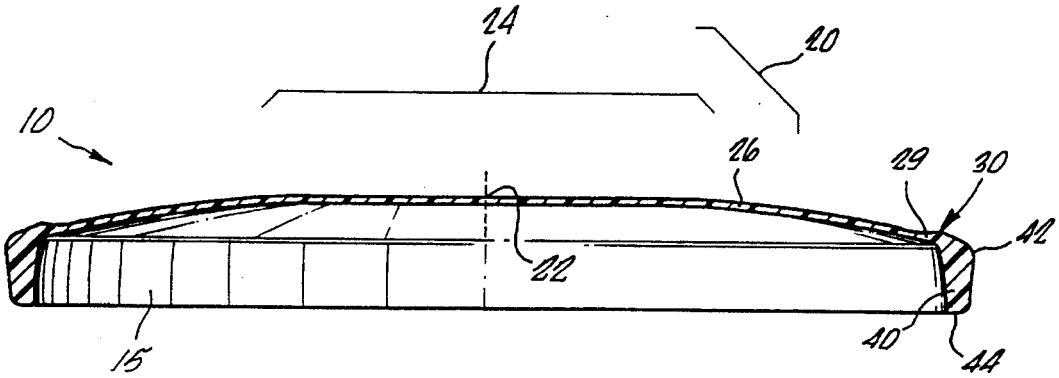
FIG. 4 is a sectional view of the flying disc of FIG. 2 taken along line 4—4.
Figure 4A:
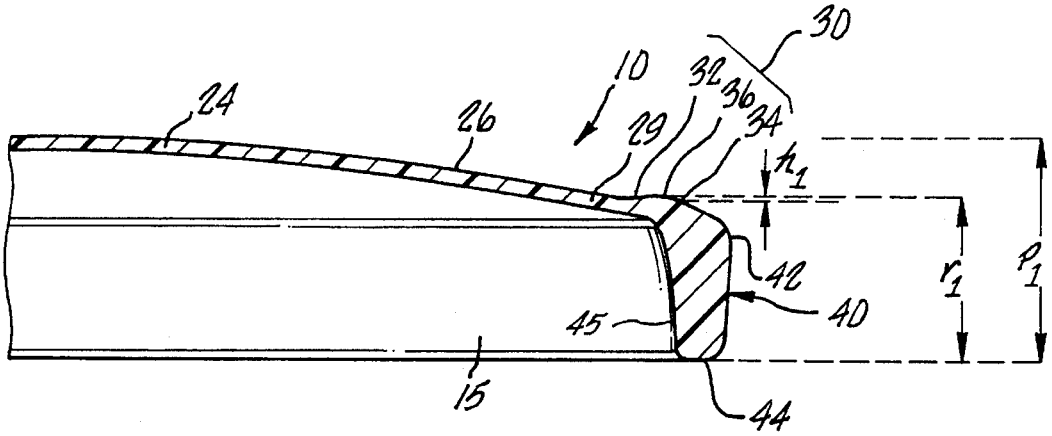
FIG. 4A is an enlarged view of a rim cross section of the flying disc of FIG. 4.

In order to provide an order of magnitude for the size of the ridge 30, referring to FIG. 4A, the ratio $h_1/r_1$ (ridge height to rim height) equals about 5.8% where $h_1$ is height of the ridge (about 0.11 cm or nearly 3/64 in);

$r_1$ is the total rim height (about 1.9 cm).

The preferred dimension will depend on disc size, disc and rim shape, and desired flight characteristics. A suitable range will be discussed below with respect to Table A.

FIGS. 5–8, 8A illustrate a second preferred design of a flying disc 100. The disc 100 is a single piece structure integrally molded from flexible plastic material. The disc 100 has a circular shape (as shown in top and bottom views FIGS. 6–7) which is symmetrical about a central axis 122. In order to further describe this disc embodiment, by way of example FIGS. 5–8, 8A are generally drawn to scale and the disc 100 may have an outer diameter of about 27.8 cm. About 57% of the mass of the disc is contained within the rim 140. For a recreational catch style disc, this disc may have mass of about 180 gm. A disc of this size and weight would be ideal for the sport of Ultimate.

The disc 100 includes a central flight plate section 120, an outer rim 140, and a shoulder section 129 connecting the central flight plate section 120 to the outer rim 140. The flight plate section 120 is comprised of a generally flat center portion 124 and a convex transition section 126. Though the center portion 124 will usually be generally flat to facilitate application of a hot stamp, it may be cambered. The center portion 124 is shown with approximately uniform thickness with the transition section 126 of decreasing thickness from the shoulder 129 to the center portion 124. It is preferred that it be sufficiently thin and flexible that the disc will bend on impact and allow the user's thumb to be pressed into the plate 120 when gripping. A plurality of fourteen gripping rings or ridges 127 (any appropriate number of rings of suitable height and depth may employed) are located on the top of the transition section 126 and are desirable features for gripping and/or catching for some users.

The outer rim 140 extends downwardly from the shoulder section 129 bounding (in a radial sense) a central cavity 115 below the central flight plate section 120. The outer rim 140 has an outer rounded edge 142 and a lower rounded corner 144. The central flight plate section 120 includes a top surface having a flat center portion 124 which transitions to a downwardly sloping convex transition section 126. The top surface of the disc 100 also includes a raised lip or ridge 130 in the vicinity of the rim 140 or the shoulder 129. The raised ridge 130 includes an upwardly sloping surface 132, a transition point or apex 136 (which is preferably sharp or abrupt), and a downwardly sloping upper rim surface 134 which transitions to the outer rounded edge 142 of the rim 140. The upwardly sloping surface 132 is generally straight or concave rather than convex, and the downwardly sloping upper rim surface 134 is generally straight or convex rather than concave.

As previously stated, to aid description the disc 100 has been drawn to scale and an example preferred diameter for the disc is about 27.8 cm with the total disc height or profile $P_2$ being about 3.4 cm. In order to provide an order of magnitude for the size of the ridge 130, referring to FIG. 8A, the ratio $h_2/r_2$ (ridge height to rim height) equals about 3.3% where $h_2$ is height of the ridge (about 0.08 cm);

$r_2$ is the total rim height (about 2.4 cm).

FIGS. 9–12, 12A illustrate a third design of a flying disc 50. The disc 50 is a single piece structure integrally molded from flexible plastic material. The disc 50 has a circular shape (as shown in top and bottom views FIGS. 10–11) which is symmetrical about a central axis 72. FIGS. 9–12, 12A are generally drawn to scale and the disc 50 may have an outer diameter of about 21 cm. About 62% of the mass of the disc is contained within the rim 90. For a lighter weight catch style disc, this disc may have mass of about 95–110 gm whereas a higher density golf style disc may have a mass of about 170–175 gm.

The disc 50 includes a central flight plate section 70, an outer rim 90, and a shoulder section 79 connecting the central flight plate section 70 to the outer rim 90. The flight plate section 70 is comprised of a generally flat center portion 74 and a convex transition section 76. Though the center portion 74 is generally flat to facilitate application of a hot stamp, it may be cambered. The central flight plate section 70 is shown with approximately uniform thickness (it may alternately be of varying and/or decreasing thickness from the shoulder 79 to the center axis 72) and it is preferred that it be sufficiently thin and flexible that the disc will bend on impact and allow the user's thumb to be pressed into the plate 70 when gripping.

The outer rim 90 of the disc 50 extends downwardly from the shoulder section 79 bounding a central cavity 65 below the central flight plate section 70. The outer rim 90 has an outer rounded edge 92 and a lower rounded corner 94. The central flight plate section 70 includes a top surface having a flat center portion 74 which transitions to a downwardly sloping convex transition section 76. The top surface of the disc 50 also includes a raised lip or ridge 80 in the vicinity of the rim 90 or the shoulder 79. The raised ridge 80 includes an upwardly sloping surface 82, a transition point or apex 86

(which is preferably sharp or abrupt), and a downwardly sloping upper rim surface 84 which transitions to the outer rounded edge 92 of the rim 90. The upwardly sloping surface 82 is generally straight or concave rather than convex, and the downwardly sloping upper rim surface 84 is generally straight or convex rather than concave.

As previously stated, to aid description the disc 50 has been drawn to scale and an example preferred diameter for the disc is about 21 cm with the total disc height or profile $P_3$ being about 2.2 cm. In order to provide an order of magnitude for the size of the ridge 80, referring to FIG. 8A, the ratio $h_3/r_3$ (ridge height to rim height) equals about 6.6% where $h_3$ is height of the ridge (about 0.12 cm);

$r_3$ is the total rim height (about 1.8 cm).

FIGS. 13–16, 16A illustrate a fourth design of a flying disc 150. The disc 150 is based on a "beveled edge" disc design such as that described in U.S. Pat. No. 4,568,297, herein incorporated by reference. The disc 150 includes a modified rim 190 with a raised ridge 180 on the top surface thereof. The disc 150 is a single piece structure integrally molded from flexible plastic material. The disc 150 has a circular shape (as shown in top and bottom views FIGS. 14–15) which is symmetrical about a central axis 172. FIGS. 13–16, 16A are generally drawn to scale and the disc 150 may have an outer diameter of about 21 cm. With its rim of generally triangular shape cross section, about 65–70% of the mass of the disc is contained within the rim 190. For a higher density golf disc, the disc mass may be about 170–175 gm.

The disc 150 includes a central flight plate section 170, an outer rim 190, and a shoulder section 179 connecting the central flight plate section 170 to the outer rim 190. The flight plate section 170 is comprised of a center portion 174 and a convex transition section 176. Though the center portion 174 will usually be generally flat to facilitate application of a hot stamp, it may be cambered. The central flight plate section 170 is shown with decreasing thickness from the shoulder 179 to the center portion 174 and it is preferred that it be sufficiently thin and flexible that the disc will bend on impact and allow the user's thumb to be pressed into the flight plate section 170 when gripping.

Figure 17:
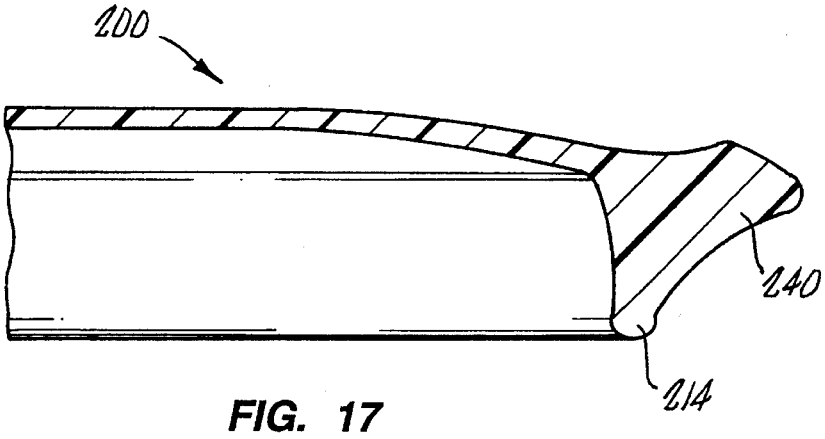
FIG. 17 is a detailed view of a rim cross section illustrating an alternate disc to that of FIGS. 12–16.

The outer rim 190 of the disc 150 extends downwardly from the shoulder section 179 bounding a central cavity 165 below the central flight plate section 170. The outer rim 190 has an outer rounded edge 192 and a lower rounded corner 194. The lower rounded corner 194 may comprise a simple curved corner as illustrated or may alternately include a bead or widened corner as shown in FIG. 17 and described below. The central flight plate section 170 includes a top surface having a flat center portion 174 which transitions to a downwardly sloping convex transition section 176. The top surface of the disc 150 also includes a raised ridge 180 in the vicinity of the rim 190 or the shoulder 179. The raised ridge 180 includes an upwardly sloping surface 182, a transition point or apex 186 (which is preferably sharp or abrupt), and a downwardly sloping upper rim surface 184 which transitions to the outer rounded edge 192 of the rim 190. The upwardly sloping surface 182 is generally straight or concave rather than convex, and the downwardly sloping upper rim surface 184 is generally straight or convex rather than concave.

To aid description, the disc 150 has been drawn to scale and an example preferred diameter for the disc is about 21 cm with the total disc height or profile $P_4$ being about 2.0 cm. In order to provide an order of magnitude for the size of the ridge 180, referring to FIG. 16A, the ratio $h_4/r_4$ (ridge height to rim height) equals about 6.1% where $h_4$ is height of the ridge (about 0.11 cm);

$r_4$ is the total rim height (about 1.8 cm).

Figure 16:
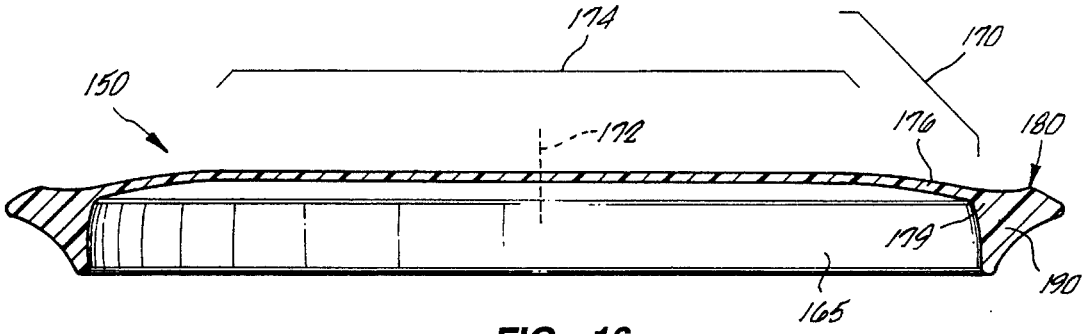
FIG. 16 is a sectional view of the flying disc of FIG. 14 taken along line 16—16.
Figure 16A:
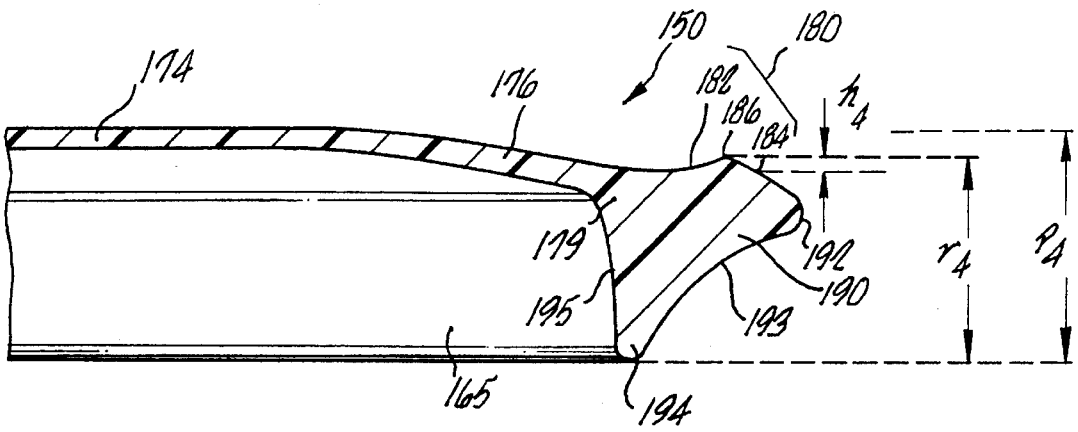
FIG. 16A is an enlarged view of the rim section of the flying disc of FIG. 16.

In the preferred design for the disc 150 as shown in FIG. 16A, outwardly from the transition point 186, the upper rim surface 184 is shown as somewhat convex. Inwardly from the transition point 186, the upwardly sloping surface 182 is shown as somewhat concave. The lower rim surface 193 of the rim 190 is preferably straight or may be somewhat concave as shown in FIG. 16A. The inner rim surface 195 is usually straight and vertical to facilitate easy release during the molding process but may be of other suitable configuration, such as the top portion being inwardly slanted.

The cross sectional shape of the rim 190 may be described as generally triangular despite the concavity of the lower rim surface 193 and despite the raised ridge 180 on the upper rim surface. As may be deduced from the drawings, the term "triangular" is therefore used to describe a general appearance to the eye rather than a precisely measured mechanical quantity. The rim shape is not a triangle but is triangular in shape. The preferred triangular shape for the rim 190 is generally equilateral which may include a more acute isosceles triangular shape also as shown in FIG. 16A (the inner rim surface 195 being the smaller of the "sides" of the triangular shape). In the "beveled edge" disc, the angle generally formed by the outer edge 192 would therefore be about 60° or less.

The triangular shaped rim 190 places a large percentage of the disc mass in the rim. As it rotates, the disc 190 is therefore stabilized by the added rim mass. Moreover, as the disc is thrown and rotated at a given maximum speed, the flight plate section 170 of the disc will flatten slightly relative to its "at rest" state. When being thrown, once the disc is released and is then "in flight", the disc may dynamically change in shape. Over the course of the released disc being "in flight", as the disc decelerates (i.e. spins more slowly), the camber of the flight plate section 170 will increase, or as described in the '297 Patent the central flight plate section may "dome upwards". It is believed that the dynamic change in camber experienced by the disc as it travels along its flight path provides improved flight characteristics.

FIG. 17 is a detailed view of a rim cross section illustrating an alternate "beveled edge" disc 200 with an outer rim 240 having a lower rounded corner 214 comprising a bead or widened corner. The bead 214 may facilitate grip and/or release of the disc when throwing. Alternately, the bead 214 may enhance durability of the disc minimizing flight deterioration due to scuffing. It should be noted that the previous embodiments of FIGS. 1–12, the respective lower rounded corner may also include such a bead.

Figure 19:
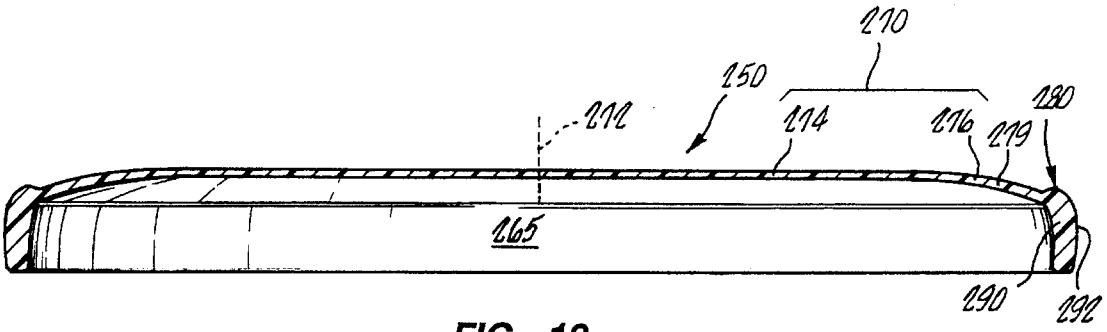
FIG. 19 is a sectional view of another flying disc.
Figure 20:
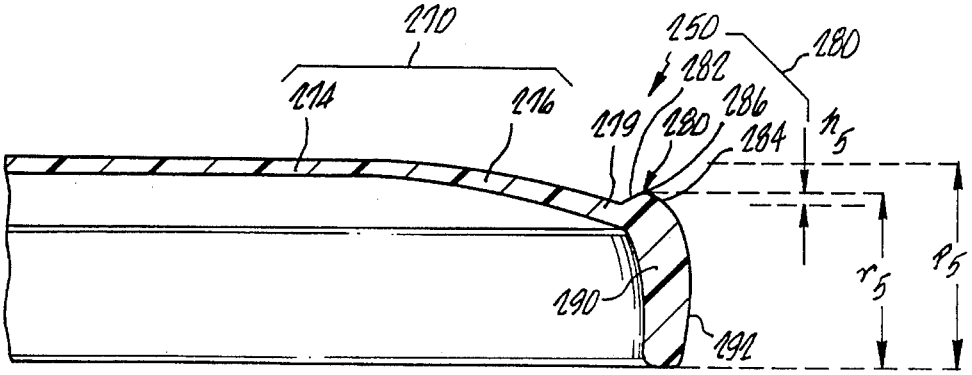
FIG. 20 is an enlarged view of a rim cross section of the flying disc of FIG. 19.

FIGS. 19–20 are cross sectional views of another embodiment of a flying disc. The disc 250 is a single piece structure integrally molded from flexible plastic material. The disc 250 has a circular shape which is symmetrical about a central axis 272. FIGS. 19–20 are generally drawn to scale and the disc 250 may have an outer diameter of about 23.5 cm. In this disc, only 50% of the mass of the disc is contained within the rim 290. For a lighter weight catch style disc, this disc may have mass of about 108 gm whereas a higher density golf style disc may have a mass of about 190 gm.

The disc 250 includes a central flight plate section 270, an outer rim 290, and a shoulder section 279 connecting the central flight plate section 270 to the outer rim 290. The flight plate section 270 is comprised of a generally flat center portion 274 and a convex transition section 276. Though the center portion 274 is generally flat to facilitate application of a hot stamp, it may be cambered. The central flight plate section 270 is shown with approximately uniform thickness (it may alternately be of varying and/or decreasing thickness from the shoulder 279 to the center axis 272) and it is preferred that it be sufficiently thin and flexible that the disc will bend on impact and allow the user's thumb to be pressed into the plate 270 when gripping.

The outer rim 290 of the disc 250 extends downwardly from the shoulder section 279 bounding a central cavity 265 below the central flight plate section 270. The outer rim 290 has an outer rounded edge 292 and a lower rounded corner 294. The central flight plate section 270 includes a top surface having a center portion 274 which transitions to a downwardly sloping convex transition section 276. The top surface of the disc 250 also includes a raised ridge 280 above the rim 290 adjacent the shoulder 279. The raised ridge 280 includes an upwardly sloping surface 282, a transition apex 286 (which is preferably sharp or abrupt), and a downwardly sloping upper rim surface 284 which transitions to the outer rounded edge 292 of the rim 290. The upwardly sloping surface 282 is generally straight or concave rather than convex, and the downwardly sloping upper rim surface 284 is generally straight or convex rather than concave.

An example preferred diameter for the disc is about 23.5 cm with the total disc height or profile $P_5$ being about 1.8 cm. In order to provide an order of magnitude for the size of the ridge 280, referring to FIG. 20, the ratio $h_5/r_5$ (ridge height to rim height) equals about 4.4% where $h_5$ is height of the ridge (about 0.08 cm);

$r_5$ is the total rim height (about 1.8 cm).

This disc, even with its low 50% rim mass/total mass ratio, has stable flight characteristics. As may be noted when compared to the disc 10 in FIG. 4A, the disc 250 has a more steeply angled upwardly sloping surface 282 (and hence a more abrupt transition apex 286) which is believed may account for the achieved stability despite the relatively unstable characteristics of the disc absent the ridge 280. It may also be noted that the raised ridge 280 is of similar configuration to the ridge 130 in FIG. 8A. As such, it is intended that the various example ridge designs may be employed on various disc configurations.

Figure 12A:
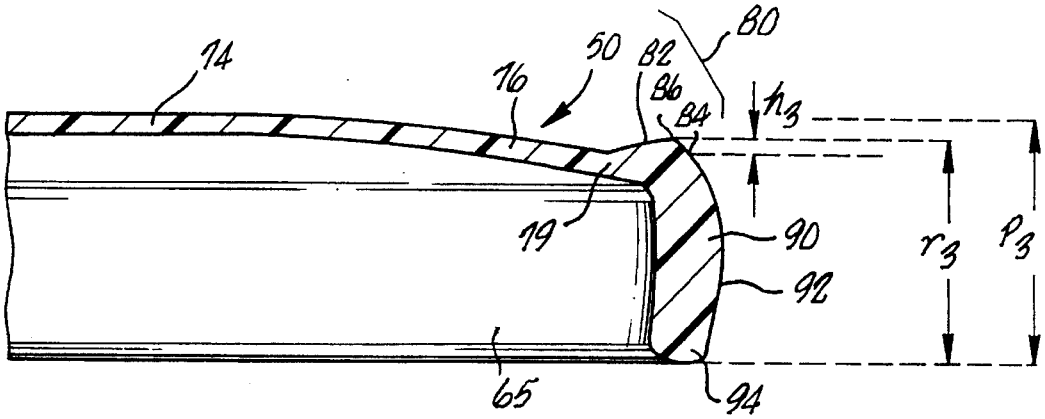
FIG. 12A is an enlarged view of the rim section of the flying disc of FIG. 12.
Figure 12:
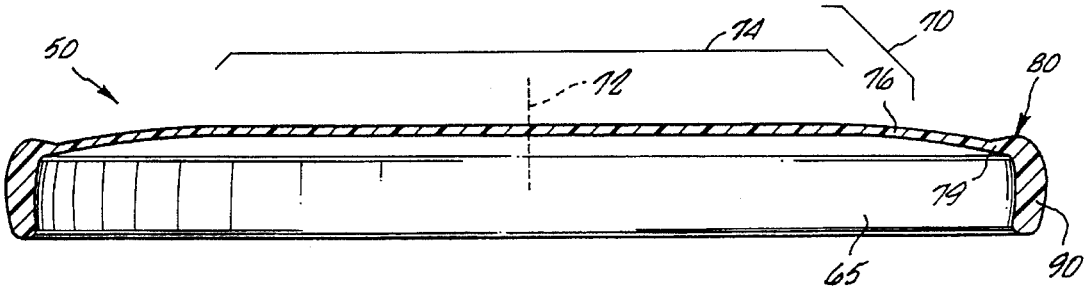
FIG. 12 is a sectional view of the flying disc of FIG. 10 taken along line 12—12.
Figure 11:
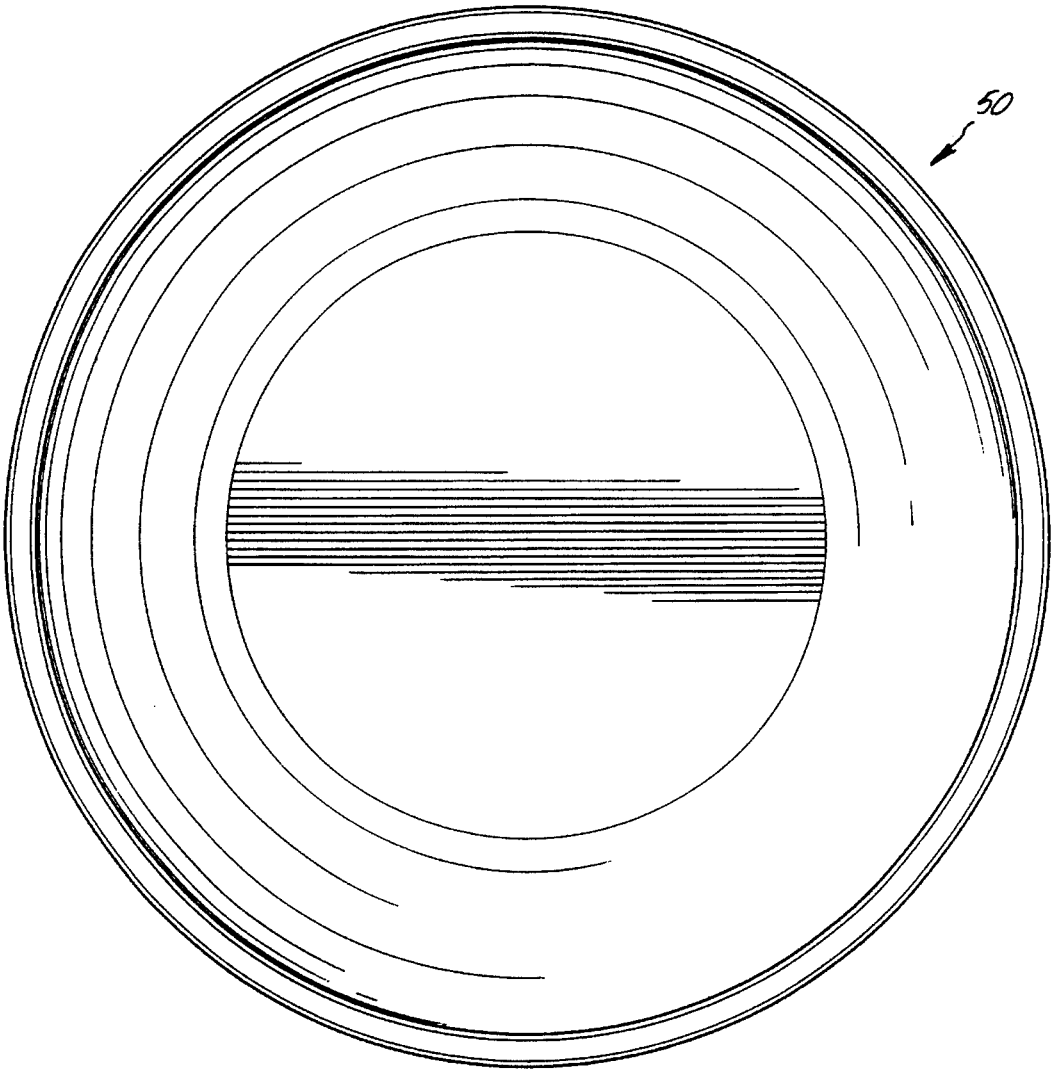
FIG. 11 is a bottom plan view of the flying disc of FIG. 9.
Figure 13:
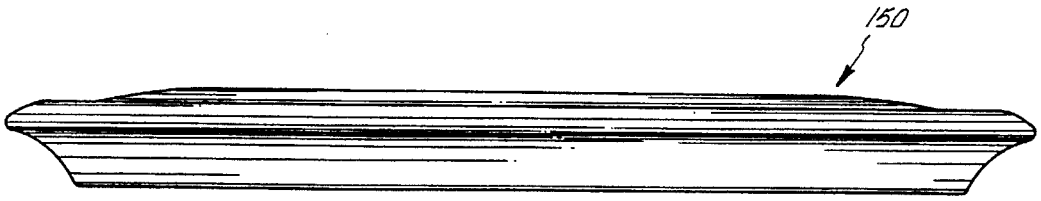
FIG. 13 is a side elevation view of another alternate flying disc.
Figure 14:
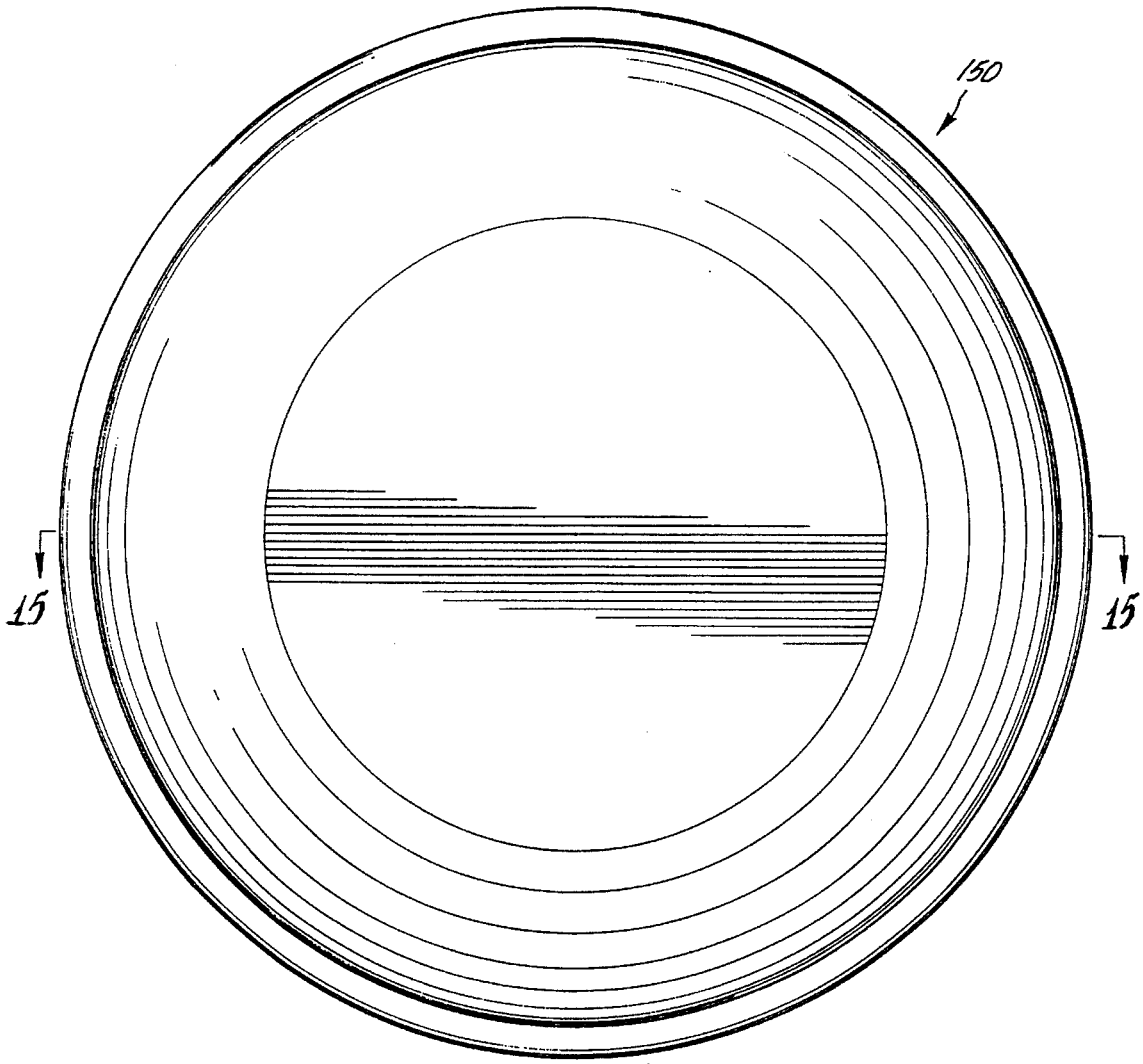
FIG. 14 is a top plan view of the flying disc of FIG. 13.
Figure 15:
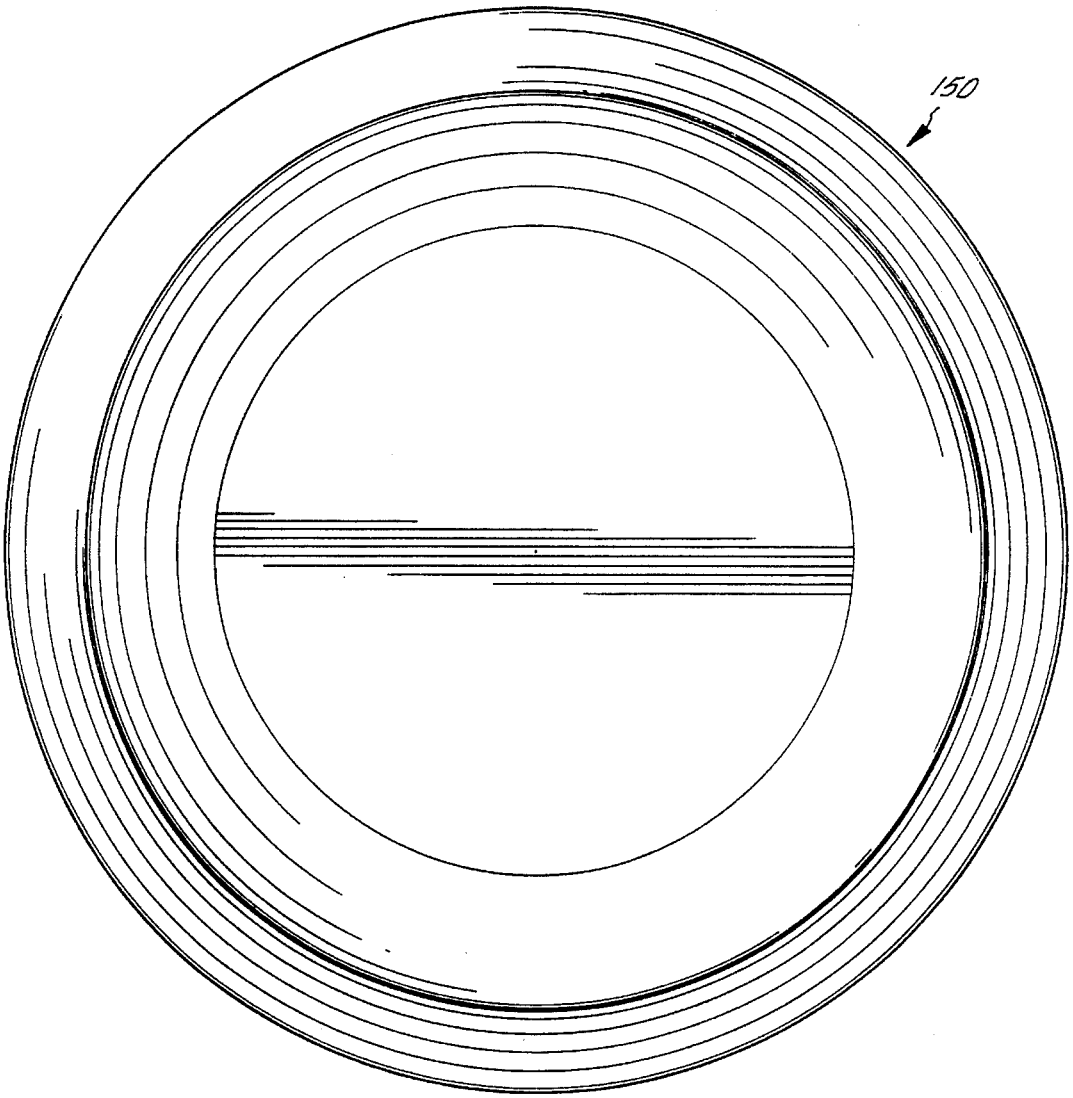
FIG. 15 is a bottom plan view of the flying disc of FIG. 13.
Figure 18:
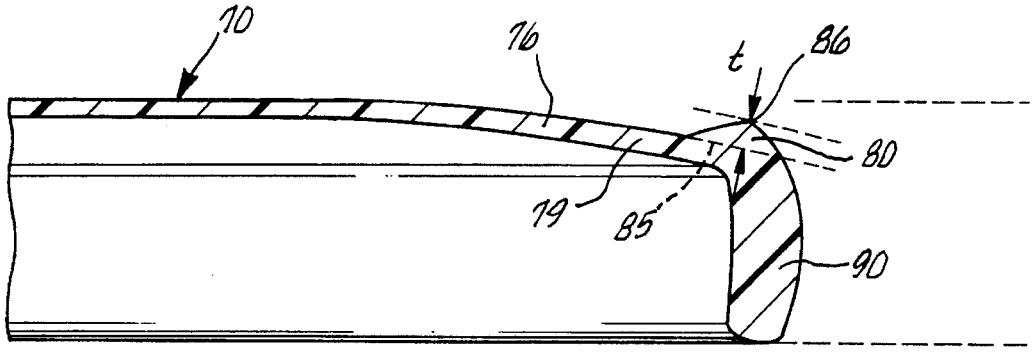
FIG. 18 is an enlarged view of a rim cross section of the flying disc of FIG. 12.

FIG. 18 illustrates a detailed view of a rim cross section of the disc 50 of FIG. 12. The rim 90 of the disc 50 includes the raised ridge 80. The height of the ridge 80 may be better described or quantified as a height or thickness t taken between the transition point or apex 86 and a continuation line 85 formed by extending the curve of the top surface of the transition section 76 of the central section 70 past the shoulder 79. If the air flow is attached, it is believed that the air passing over the central flight plate section 70 will follow the curve of the top surface of the transition section 76, i.e. along continuation line 85. Therefore the air flow would see a transition possibly better designated by thickness t. In the disc 50, the value of t is about 0.16 cm (0.040 in.).

The following Table A summarizes the measurements of the above embodiments:

TABLE A

| Disc | diameter d | rim height r | ridge height h | ratio h/r | ridge thk t | ratio t/d |
|---|---|---|---|---|---|---|
| 10 | 24 cm | 1.9 cm | 0.11 cm | 5.8% | 0.125 cm | 0.52% |
| 100 | 27.8 cm | 2.4 cm | 0.08 cm | 3.3% | 0.10 cm | 0.36% |
| 50 | 21 cm | 1.8 cm | 0.12 cm | 6.6% | 0.16 cm | 0.76% |

TABLE A-continued

| Disc | diameter d | rim height r | ridge height h | ratio h/r | ridge thk t | ratio t/d |
|---|---|---|---|---|---|---|
| 150 | 21 cm | 1.8 cm | 0.11 cm | 6.1% | 0.25 cm | 1.2% |
| 250 | 23.5 cm | 1.8 cm | 0.08 cm | 4.4% | 0.10 cm | 0.43% |

The size and shape of the raised ridge will depend on the specific disc size and configuration. Nonetheless for a flying disc of a typical diameter used for catching and/or throwing, some preferred ranges for the ridge may be quantified. The terms being employed are as used in Table A and defined above. A preferred height h is about 0.1 cm. A preferred range for the height h of the raised ridge is from about 0.05 cm to 0.3 cm or more specifically from about 0.08 cm to 0.2 cm or from about 0.1 cm to 0.15. Similarly a preferred range for a thickness t of the raised ridge is from about 0.05 cm to 0.4 cm or more specifically from about 0.05 cm to 0.25 cm or from about 0.1 cm to 0.25 cm. A preferred range for ratio h/r between ridge height and total rim height is from about 3% to 9% or more specifically from about 3.5% to 7%.

The desired size of the raised ridge 30 may also depend upon the configuration of the ridge itself. For example, it is believed that a ridge with a sharper or more abrupt transition (e.g. if the disc 10 in FIG. 4A with a steeper upwardly sloping surface 32) would not require as great a ridge height to achieve the desired effect. Whatever the configuration of the raised ridge, it is preferred that the ridge be of small dimensions, such as those indicated in the foregoing examples. As to throwability, too large a ridge may result in a thumb grip which is uncomfortable to grip and release. As for flight characteristics, too large a ridge may result in too great an aerodynamic impact. An overly large ridge may, for example, affect lower speed as well as higher speed flight. Overall, the ridge must be large enough (as combined with a sufficiently abrupt transition) to provide the desired aerodynamic effect and to provide the desired gripping surface. It is preferred that the ridge ratio h/r (defined above) be in the range from 3% to 15% ($3\% \leqq h/r \leqq 15\%$) but preferably less than 10%. Given the curve of the top surface of the rim, a disc may be constructed with the value of h approaching zero and yet have a positive value for t potentially providing the desired aerodynamic effect even if the gripping surface is ineffective.

Thus, embodiments of a flying disc have been shown and described. Though certain examples and advantages have been disclosed, further advantages and modifications may become obvious to one skilled in the art from the disclosures herein. The invention therefore is not to be limited except in the spirit of the claims that follow.

I claim:

1. A flying disc for catching and/or throwing, comprising a single piece structure integrally molded from flexible plastic material and having a central flight plate section, an outer rim, and a shoulder section connecting said central flight plate section to said outer rim, said outer rim extending downwardly from said shoulder section bounding a central cavity below said central flight plate section, said outer rim having an outer rounded edge and a lower rounded corner, the disc including a top surface having a generally flat center portion outwardly transitioning to a downwardly curved convex section, outwardly transitioning to an upwardly sloping surface to an abrupt transition point above said outer rim, and then outwardly transitioning to a downwardly sloping upper rim surface to said outer rounded edge, the disc having a transition point height h to rim height r ratio $h/r \leqq 10\%$, wherein the transition point height h is measured from a lowest point on said upwardly sloping surface to said transition point and total rim height r is measured from a bottom of the lower rounded corner to said transition point, said upwardly sloping surface being non-convex, and said downwardly sloping upper rim surface being generally convex.

2. A flying disc according to claim 1 wherein said transition point has a height, from a lowest point on said upwardly sloping surface to said transition point, in a range of about 0.05 cm to 0.3 cm.

3. A flying disc according to claim 1 having a transition point height h to rim height r ratio h/r from 3% to 9%.

4. A flying disc according to claim 1 having a transition point height h to rim height r ratio h/r from 3.5% to 7%.

5. A flying disc according to claim 1 wherein said upwardly sloping surface, said transition point, and said downwardly sloping upper rim surface comprise a raised ridge, said disc having a ratio t/d of raised ridge thickness t, as measured from said transition point to a curved line formed by extending a curve of said top surface of said downwardly curved convex section past said shoulder section, to disc outer diameter d of from 0.36% to 1.2%.

6. A flying disc according to claim 1 wherein said upwardly sloping surface, said transition point, and said downwardly sloping upper rim surface comprise a raised ridge, said transition point comprising a corner having a radius on the order of 0.2 cm or less.

7. A flying disc according to claim 1 wherein said upwardly sloping surface, said transition point, and said downwardly sloping upper rim surface comprise a raised ridge, said transition point comprising a corner having a radius on the order of 0.1 cm or less.

8. A flying disc according to claim 1 wherein the transition point is located on the top surface of the outer rim at a position which provides for a gripping surface to aid in throwing of the flying disc.

9. A flying disc according to claim 1 wherein the transition point is located on the top surface of the outer rim in the vicinity of the shoulder section.

10. A flying disc according to claim 1 wherein the outer rim has a cross section of generally triangular shape, the outer rounded edge comprising a rounded corner, wherein the transition point is located on the top surface of the outer rim centrally between the shoulder and the outer rounded edge.

11. A flying disc according to claim 1 wherein the outer rim has an inner surface bounding the central cavity, wherein the transition point is located on the top surface of the outer rim above the inner surface.

12. A flying disc for catching and/or throwing, comprising a single piece structure integrally molded from flexible plastic material and having a central flight plate section, an outer rim, and a shoulder section connecting said central flight plate section to said outer rim, said outer rim extending downwardly from said shoulder section bounding a central cavity below said central flight plate section, said outer rim having an outer rounded edge and a lower rounded corner, the disc including a top surface having a generally flat center portion outwardly transitioning to a downwardly curved convex section, outwardly transitioning to an upwardly sloping surface to an abrupt transition point above said outer rim, and then outwardly transitioning to a downwardly sloping upper rim surface to said outer rounded edge, said upwardly sloping surface being non-convex, and said downwardly sloping upper rim surface being generally convex, wherein said transition point has a height, from a lowest point on said upwardly sloping surface to said transition point, of about 0.1 cm.

13. A flying disc comprising a single piece structure integrally molded from flexible plastic material and having a central flight plate section, an outer rim, and a shoulder section connecting said central flight plate section to said outer rim, said outer rim extending downwardly from said shoulder section bounding a central cavity below said central flight plate section, said outer rim having an outer rounded edge and a lower rounded corner, the disc including a top surface having a generally flat center portion outwardly transitioning to a downwardly curved convex section, outwardly transitioning to an upwardly sloping surface to an abrupt transition point above said outer rim, and then outwardly transitioning to a downwardly sloping upper rim surface to said outer rounded edge, said upwardly sloping surface being non-convex, and said downwardly sloping upper rim surface being generally convex, wherein said upwardly sloping surface, said transition point, and said downwardly sloping upper rim surface comprise a raised ridge, said raised ridge having a thickness, as measured from said transition point to a curved line formed by extending a curve of said top surface of said downwardly curved convex section past said shoulder section, in a range from 0.1 cm to 0.4 cm, the disc having a diameter on the order of 21 cm to 28 cm.

14. A flying disc according to claim 13 wherein the transition point is located on the top surface of the outer rim at a position which provides for a gripping surface to aid in throwing of the flying disc.

15. A flying disc according to claim 13 wherein the transition point is located on the top surface of the rim in the vicinity of the shoulder section.

16. A flying disc according to claim 13 wherein the outer rim has an inner surface bounding the central cavity, wherein the transition point is located on the top surface of the outer rim above the inner surface.

17. A flying disc for catching and/or throwing, comprising a single piece structure integrally molded from flexible plastic material and having a central flight plate section, an outer rim, and a shoulder section connecting said central flight plate section to said outer rim, said outer rim extending downwardly from said shoulder section bounding a central cavity below said central flight plate section, said outer rim having an outer rounded edge and a lower rounded corner, the disc including a top surface having a generally flat center portion outwardly transitioning to a downwardly curved convex section, outwardly transitioning to an upwardly sloping surface to an abrupt transition point above said outer rim, and then outwardly transitioning to a downwardly sloping upper rim surface to said outer rounded edge, said upwardly sloping surface being non-convex, and said downwardly sloping upper rim surface being generally convex, wherein said upwardly sloping surface, said transition point, and said downwardly sloping upper rim surface comprise a raised ridge, said raised ridge having a thickness, as measured from said transition point to a curved line formed by extending a curve of said top surface of said downwardly curved convex section past said shoulder section, of about 0.1 cm.

18. A flying disc, comprising a single piece structure integrally molded from flexible plastic material and having a central flight plate section, an outer rim, and a shoulder section connecting the central flight plate section to the outer rim, the outer rim extending downwardly from the shoulder section and bounding a central cavity below the central flight plate section, the outer rim having an outer rounded edge, a lower rounded corner, and a top surface having a raised ridge, the raised ridge comprising an upwardly sloping non-convex surface on a radially inward side thereof, a downwardly sloping non-concave surface on a radially outward side thereof, and an upper transition apex therebetween, the raised ridge having a height, from a lowest point on the upwardly sloping surface to the transition apex, in a range of from 0.05 cm to 0.3 cm.

19. A flying disc according to claim 18 wherein the downwardly sloping surface being generally convex.

20. A flying disc according to claim 18 wherein the height of the raised ridge is about 0.1 cm.

21. A flying disc according to claim 18 wherein the outer rim has a cross section of generally triangular shape, the outer rounded edge comprising a rounded corner, wherein the raised ridge is located on the top surface of the outer rim generally centrally between the shoulder and the outer rounded edge.

22. A flying disc according to claim 18 having a ratio h/r between height h of the raised ridge and a total rim height r from 3% to 9%.

23. A flying disc according to claim 18 having a ratio h/r between height h of the raised ridge and a total rim height r from 3.5% to 7%.

24. A flying disc according to claim 18 wherein the raised ridge is located on the top surface of the outer rim at a position which provides for a gripping surface to aid in throwing of the flying disc.

25. A flying disc according to claim 18 wherein the raised ridge is located on the top surface of the outer rim in the vicinity of the shoulder section.

26. A flying disc according to claim 18 wherein the outer rim has an inner surface bounding the central cavity, wherein the raised ridge is located on the top surface of the outer rim above the inner surface.

27. A flying disc according to claim 18 wherein the central flight plate section forms a single continuous convex curved top surface from a center thereof to the shoulder section.

28. A flying disc according to claim 21 wherein the rounded corner forms an angle of about 60°.

29. A flying disc according to claim 21 wherein the rounded corner forms an angle of less than about 60°.

30. A flying disc, comprising a single piece structure integrally molded from flexible plastic material and having a central flight plate section, an outer rim, and a shoulder section connecting the central flight plate section to the outer rim, the outer rim extending downwardly from the shoulder section and bounding a central cavity below the central flight plate section, the outer rim having an outer rounded edge, a lower corner, and a top surface having a raised ridge, the raised ridge comprising an upwardly sloping surface on a radially inward side thereof, a downwardly sloping surface on a radially outward side thereof, and an upper transition apex therebetween, the upper transition apex comprising a corner having a radius of no more than about 0.2 cm, said upwardly sloping surface of said raised ridge being non-convex, and said downwardly sloping surface of said raised ridge being convex.

31. A flying disc according to claim 30 wherein the disc is of the type conventionally used for throwing and/or catching, the disc having an outer diameter of about 21 cm–28 cm.

32. A flying disc according to claim 30 wherein the raised ridge is located on the top surface of the rim at a position which provides for a gripping surface to aid in throwing of the flying disc.

33. A flying disc according to claim 30 wherein the raised ridge is located on the top surface of the outer rim in the vicinity of the shoulder section.

34. A flying disc according to claim 30 wherein the outer rim has an inner surface bounding the central cavity, wherein the raised ridge is located on the top surface of the outer rim above the inner surface.

35. A flying disc comprising a structure molded from flexible plastic material and having a central flight plate section, an outer rim, and a shoulder section connecting the central flight plate section to the outer rim, the outer rim extending downwardly from the shoulder section and bounding a central cavity below the central flight plate section, the outer rim having an outer rounded edge, a lower corner, and a top surface having a raised ridge, the raised ridge comprising an upwardly sloping non-convex surface on a radially inward side thereof, a downwardly sloping non-concave surface on a radially outward side thereof, and an upper transition apex therebetween, the disc having a ratio t/d from 0.36% to 1.2% where t=thickness of the raised ridge as measured from the transition apex to a curved line formed by extending a curve of said top surface adjacent said shoulder section past said shoulder section, and d=outer diameter of the disc.

36. A flying disc according to claim 35 wherein the central flight plate section forms a single continuous convex curved top surface from a center thereof to the shoulder section.

* * * * *